US007706711B2

(12) United States Patent
Shinchi et al.

(10) Patent No.: US 7,706,711 B2
(45) Date of Patent: Apr. 27, 2010

(54) COMPUTER READABLE RECORDING MEDIUM STORED WITH CONTROL PROGRAM FOR CONTROLLING IMAGE FORMING APPARATUS, PRINTING SETTING APPARATUS, AND PRINTING SETTING METHOD

(75) Inventors: Toshimi Shinchi, Saitama (JP); Tamotsu Sakuraba, Sagamihara (JP); Michihiro Nakagawa, Sagamihara (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 281 days.

(21) Appl. No.: 11/779,302

(22) Filed: Jul. 18, 2007

(65) Prior Publication Data

US 2008/0260412 A1 Oct. 23, 2008

(30) Foreign Application Priority Data

Apr. 17, 2007 (JP) ..... 2007-108579

(51) Int. Cl.
*G03G 15/00* (2006.01)

(52) U.S. Cl. ..... 399/81; 399/82; 399/382

(58) Field of Classification Search ..... 399/81, 399/82, 382
See application file for complete search history.

(56) References Cited

U.S. PATENT DOCUMENTS 6,571,072 B1 * 5/2003 Sugimoto ..... 399/81
6,751,426 B2 * 6/2004 Akiba et al. ..... 399/82
7,097,369 B2 * 8/2006 Barry et al. ..... 399/382 X
2004/0061897 A1 4/2004 Onishi
2004/0263869 A1 * 12/2004 Kimura ..... 358/1.1

FOREIGN PATENT DOCUMENTS

JP 2004-126871 4/2004
JP 2004-199359 7/2004
JP 2005-182757 A 7/2005
JP 2006-065729 3/2006

OTHER PUBLICATIONS

U.S. Appl. No. 11/748,582, Tamotsu Sakuraba et al., filed May 15, 2007.
U.S. Appl. No. 11/802,054, Tamotsu Sakuraba et al., filed May 18, 2007.
U.S. Appl. No. 11/802,037, Toshimi Shinchi et al., filed May 18, 2007.
U.S. Appl. No. 11/802,039, Toshimi Shinchi et al., filed May 18, 2007.

(Continued)

*Primary Examiner*—Sandra L Brase
(74) *Attorney, Agent, or Firm*—Buchanan Ingersoll & Rooney PC

(57) ABSTRACT

The invention provides a user with a first tab printing setting part for setting up an item concerning printing on a first tab sheet and a second tab printing setting part for setting up an item concerning printing on a second tab sheet; and setting up, when the value of an item is set up in one of the first tab printing setting part and the second tab printing setting part, a value of the corresponding item in the other one of the first and second tab printing setting parts in dependence upon the value of the item in the aforementioned one of the parts.

45 Claims, 12 Drawing Sheets

OTHER PUBLICATIONS

U.S. Appl. No. 11/802,038, Toshimi Shinchi et al., filed May 18, 2007.

U.S. Appl. No. 11/748,598, Toshimi Shinchi et al., filed May 15, 2007.

U.S. Appl. No. 11/806,038, Shigeru Sakamoto, filed May 29, 2007.

U.S. Appl. No. 11/771,041, Michihiro Nakagawa et al., filed Jun. 29, 2007.

U.S. Appl. No. 11/812,025, Koichi Ono, filed Jun. 14, 2007.

U.S. Appl. No. 11/822,531, Michihiro Nakagawa et al., filed Jul. 6, 2007.

Notification of Reason for Refusal in JP 2007-108579 dated Apr. 21, 2009, and an English Translation thereof.

* cited by examiner (A)

FIG.13

400

| | Setting item | Tab A | Tab B |
|---|---|---|---|
| 401 | Font Name | Arial | Arial |
| 402 | Style | Bold | Italic |
| 403 | Size | 10 | 10 |
| 404 | Position Vertical | Center | Center |
| 405 | Position Horizontal | Right | Right |
| 406 | Orientation | Normal | Normal |

COMPUTER READABLE RECORDING MEDIUM STORED WITH CONTROL PROGRAM FOR CONTROLLING IMAGE FORMING APPARATUS, PRINTING SETTING APPARATUS, AND PRINTING SETTING METHOD

CROSS-REFERENCE TO RELATED APPLICATION

This application is based on Japanese Patent Application No. 2007-108579, filed on Apr. 17, 2007, the contents of which are incorporated herein by reference.

BACKGROUND

1. Technical Field

The present invention relates to a computer readable recording medium stored with a control program for controlling an image forming apparatus having tab sheet inserting function, a printing setting apparatus, and a printing setting method.

2. Description of Related Art

There exist printing apparatuses that are capable of creating printed products by inserting between pages a tab sheet having a flat rectangular main body and a tab protruding at a specified position on a side of said may body. See Unexamined Japanese Patent Publication No. 2005-182757. Index texts can be printed on the tab of the tab sheet using such a printing apparatus.

It is preferable to be able to insert different tab sheets, e.g., different types of tab sheets, at a page position indicating a "chapter" break and a page position indicating a "section" break of a printed product, respectively, when the printed product consists of chapters and sections.

However, if the chapter tab sheet used for the "chapter" break and the section tab sheet used for the "section" break are to be used distinguishably, the user must conduct settings for the items concerning printing on tabs such as font names and sizes of characters for the chapter sheet and the section sheet separately. Consequently, the operation is not only complicated but also presents an inherent problem that a confusion by the user in setting up, for example, the fonts of the characters to be printed on the chapter tab sheet and the section tab sheet may end up in a result contrary to the user's intention.

On the other hand, the technology described in the aforementioned document has no consideration for the method of using tab sheets for a plurality of different purposes as exemplified by the tab sheets used at the breakpoints of "chapters" and the tab sheets used at the breakpoints of "sections," so that it does not provide a means of solving the abovementioned problem.

SUMMARY

To solve at least one of the abovementioned problems, there is provided a computer readable recording medium stored with a control program for controlling an image forming apparatus, which reflects one aspect of the present invention. The control program causes a computer to execute a process which comprises: 1) providing a user with a first setting part for setting up an item concerning printing on a first tab sheet and a second setting part for setting up an item concerning printing on a second tab sheet; and 2) setting up, when a value of an item in one of said first setting part and said second setting part is set up, a value of the corresponding item in the other one of said first setting part and said second setting part in dependence upon the value of the item in said one of the parts.

In step 2), it is preferable that the value of the item in said other one of said first setting part and said second setting part is set up in dependence upon and to be different from the value of the corresponding item of said one of the parts.

The item to be linked in such a way that it is different from each other in said first setting part and said second setting part is preferably the item specified by the user.

In step 2), it is preferable that the value of the item in said other one of said first setting part and said second setting part is set up in dependence upon and to be the same as the value of the corresponding item of said one of the parts.

In step 2), it is preferable that the value of said item in said other one of said first setting part and said second setting part is linked with and to be the same as the value of said item if said first tab sheet is different in type from said second tab sheet.

It is preferable that step 2) is executed when the dependency between the values of the item in said first setting part and said second setting part is specified by the user.

It is preferable that the items include at least one of the font name, character style, character size, vertical printing position, horizontal printing position, and printing orientation.

The objects, features, and characteristics of this invention other than those set forth above will become apparent from the description given herein below with reference to preferred embodiments illustrated in the accompanying drawings.

BRIEF DESCRIPTION OF THE DRAWINGS

FIG. 13 is a diagram showing an example of the tab setting table.

DETAILED DESCRIPTION

The embodiment of this invention will be described below with reference to the accompanying drawings.

Figure 1:
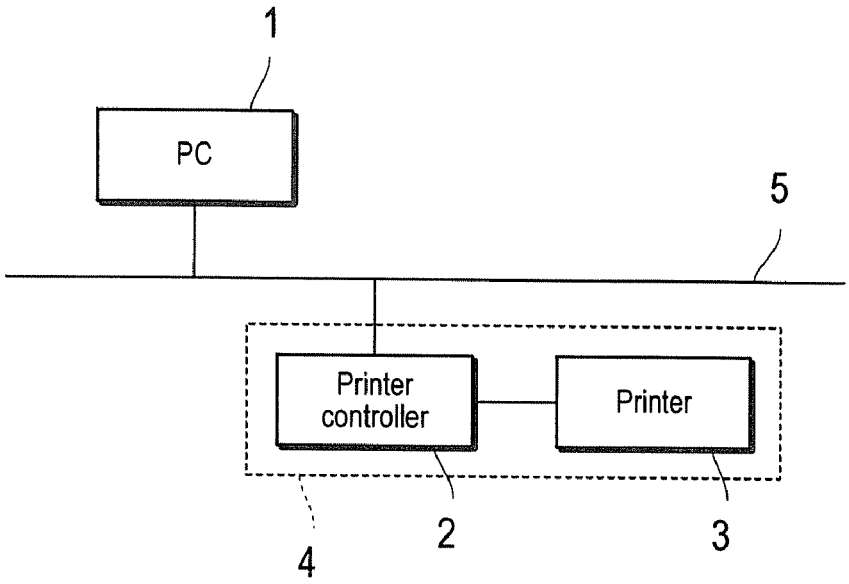
FIG. 1 is a block diagram showing the overall constitution of a network system according to an embodiment of the present invention.

FIG. 1 is a block diagram showing the overall constitution of a network system according to an embodiment of the present invention.

The network system that relates to this embodiment is equipped with a PC 1 as a printing setting apparatus for instructing the printing of the document and the like, and a printing system 4 for conducting printing based on printing instructions of the PC 1, which are connected with each other via a network 5. Also, the PC 1 and the printing system 4 can be connected directly (local connection) without recourse to the network 5.

The printing system 4 consists of a printer controller 2 and a printer 3 as an image forming apparatus and also as a tab sheet insertion apparatus, which are locally connected with each other. This local connection can be accomplished by means of various local connection interfaces, such as serial interfaces, e.g., USB and IEEE 1394, parallel interfaces, e.g., SCSI and IEEE 1284, wireless communication interfaces, e.g., Bluetooth®, IEEE 802.11, HomeRF®, IrDA®, etc. However, the printer controller 2 and the printer 3 can be connected via the network 5.

Figure 2:
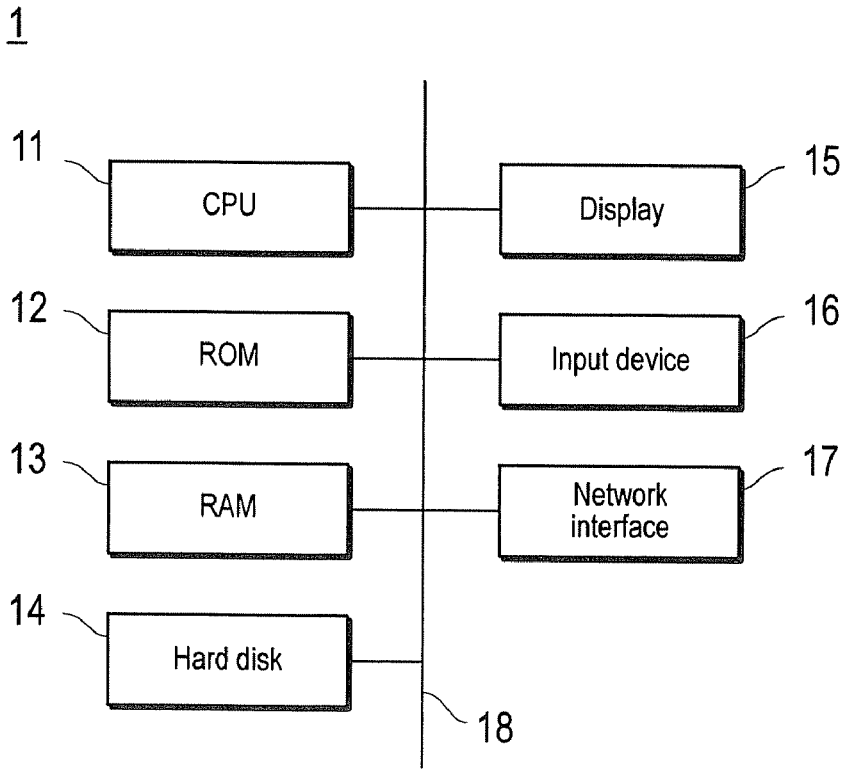
FIG. 2 is a block diagram showing the constitution of the PC shown in FIG. 1.

FIG. 2 is a block diagram showing the constitution of PC 1 shown in FIG. 1.

The PC 1 contains a CPU 11, a ROM 12, a RAM 13, a hard disk 14, a display 15, an input device 16 and a network interface 17, all of which are interconnected via a bus 18 for exchanging signals.

The CPU 11 controls various parts indicated above and executes various arithmetic processes according to a program. The ROM 12 stores various programs and data. The RAM 13 stores programs and data temporarily as a working area. The hard disk 14 stores various programs including an operating system and data.

An application program for generating document files and a printer driver for converting the document files into PDL data described in a Page Description Language ("PDL") understood by the printing system 4 are installed on the hard disk 14. The printer driver is capable of providing instructions for printing document files prepared with the use of applications, setting up printing output conditions, and setting up tab sheet related matters. The printer drive contains programs for executing these settings.

The display 15 can be LCD, CRT, and other displays, on which various kinds of information are displayed. The input device 16 includes a pointing device such as a mouse, a keyboard, and others, and is used for executing various kinds of information inputs.

The network interface 17 is an interface for communicating with other devices on the network via the network 5 using standards such as Ethernet®, Token Ring, FDDI, etc.

Figure 3:
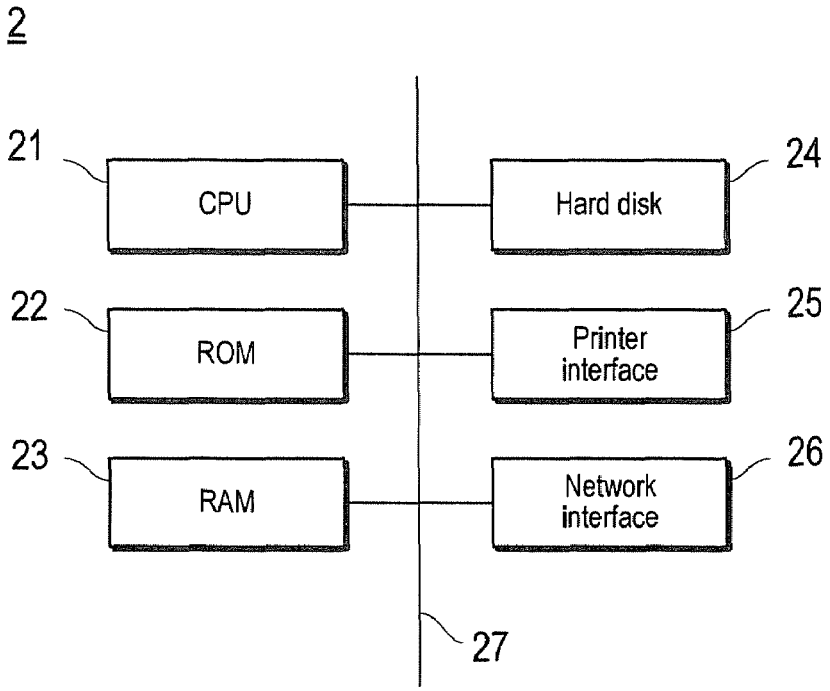
FIG. 3 is a block diagram showing the constitution of the printer controller of the printing system shown in FIG. 1.

FIG. 3 is a block diagram showing the constitution of the printer controller 2 of the printer system 4 shown in FIG. 1.

The printer controller 2 is provided with a CPU 21, a ROM 22, a RAM 23, a hard disk 24, a printer interface 25, and a network interface 26, all of which are interconnected with each other via a bus 27 for exchanging signals. The descriptions of those parts of the printer controller 2 that have the same functions as those of the corresponding parts of the PC 1 will be omitted here to avoid being duplicative.

The ROM 22 and hard disk 24 stores a rasterizing process program for translating PDL data received from PC1 and developing it into bitmap data, which is bitmap type image data, as well as an image data process program for analyzing the received PDL data. The received PDL data and the bitmap data can be saved on the hard disk 24.

The printer interface 25 is an interface for communicating with the locally connected printer 3.

Figure 4:
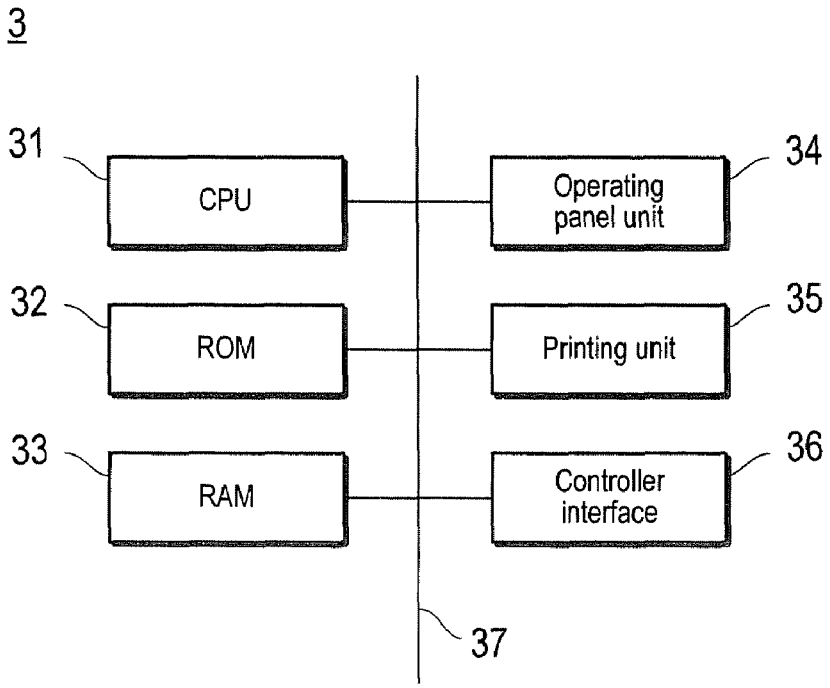
FIG. 4 is a block diagram showing the constitution of the printer of the printing system shown in FIG. 1.

FIG. 4 is a block diagram showing the constitution of the printer 3 of the printing system 4 shown in FIG. 1. The printer 3 has a CPU 31, a ROM 32, a RAM 33, an operating panel 34, a printing unit 35, and a controller interface 36, all of which are interconnected with each other via a bus 37 for exchanging signals. The descriptions of those parts of the printer 3 that have the same functions as those of the corresponding parts of the PC 1 will be omitted here to avoid being duplicative.

The ROM 32 stores a printing process program to be executed based on printing data containing bitmap data received from the printer controller 2.

The operating panel unit 34 is equipped with a touch panel, a ten-key pad, a start button, a stop button and others to be used for displaying various data and entering various instructions.

The printing unit 35 prints images based on bitmap data received from the printer controller 2 using a publicly known imaging process such as the electronic photography process on recording media such as paper. The controller interface 36 is an interface for communicating with the locally connected printer controller 2.

Figure 5:
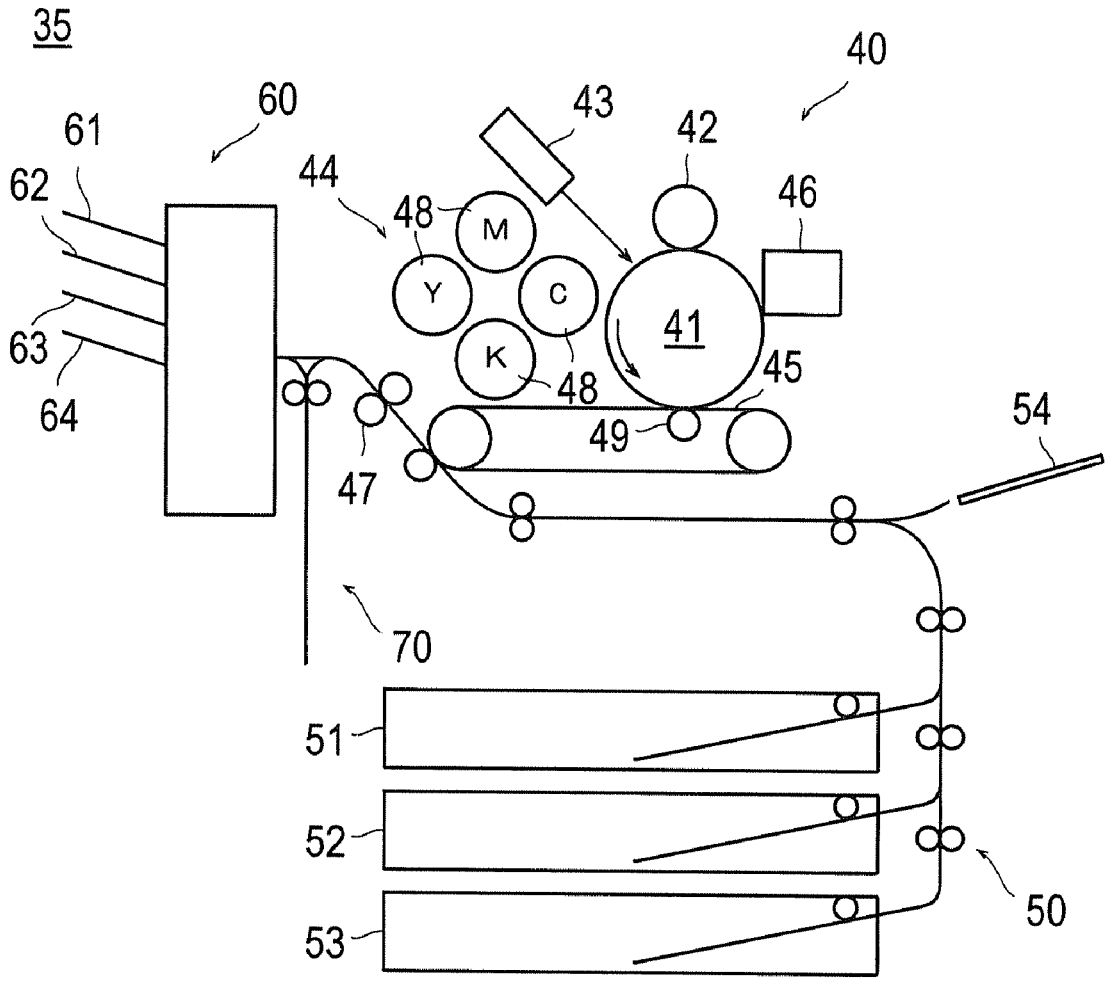
FIG. 5 is a diagram showing the typical constitution of a printing unit.

FIG. 5 is a diagram showing the typical constitution of a printing unit 35.

The printing unit 35 has a paper supply unit 50 for supplying recording media such as printing paper and insertion sheets such as tab sheets, an image forming unit 40 for forming images on the recording media, and a paper discharge unit 60 for discharging printing paper and tab sheets. The printing unit 35 also has a reversing mechanism unit 70 for reversing the front and back sides of printing paper.

The image forming unit 40 of the printing unit 35 has a sensitizer drum 41 that rotates in the arrow direction, a charging device 42, exposing device 43, a developing device 44, an intermediate transfer belt 45, a cleaning device 46, and a fixing device 47. After the surface of the sensitizer drum 41 is evenly charged by means of the charging device 42, an electrostatic latent image is formed on the surface of the sensitizer drum 41 as it is irradiated with laser beams by the exposing device 43. The electrostatic latent image becomes an apparent image as the toner adheres to the electrostatic latent image on the sensitizer drum 41 in accordance with the rotation of the sensitizer drum 41. The developing device 44 has developing rollers 48 of cyan (C), magenta (M), yellow (Y), and black (K) respectively. The toner images of these colors thus becoming apparent images are then transported to the transferring unit 49 where they are transferred onto the intermediate transfer belt 45 one after the other to be overlaid on top of each other. The overlaid color images are then transferred onto the printing paper supplied by the paper supply unit 50. The toner images are then fixed on the printing paper by the fixing device 47 and transported to the paper discharge unit 60.

The paper supply unit 50 has a plurality of sheet supply trays 51-54. The sheet supply tray 54 is a manual feed sheet supply tray. The paper discharge unit 60 is equipped with a plurality of paper discharge trays 61-64. The paper discharge unit 60 may have a post-processing part for providing post-processes such as punching or stapling to the printing paper transported there.

Figure 6:
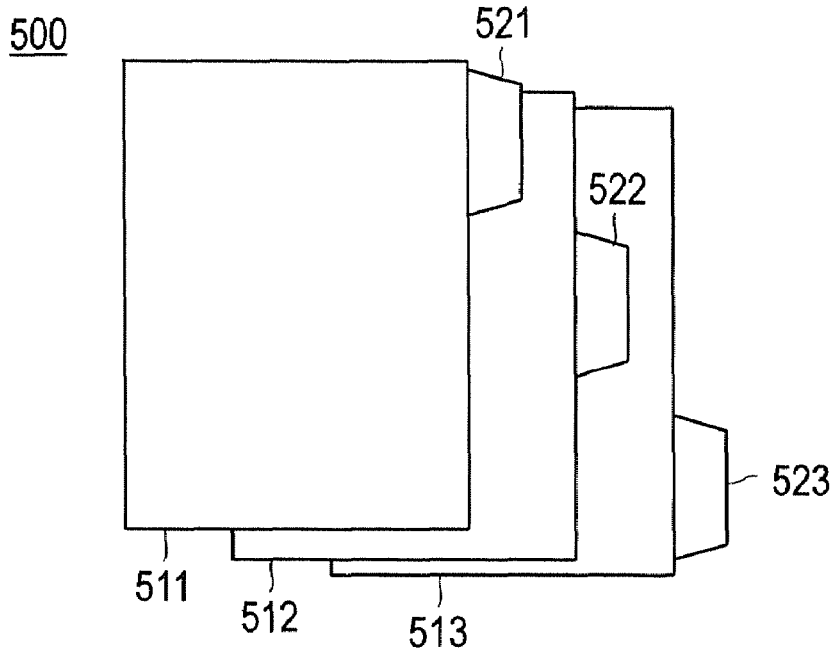
FIG. 6 is a diagram showing tab sheets used in this embodiment.
Figure 6:
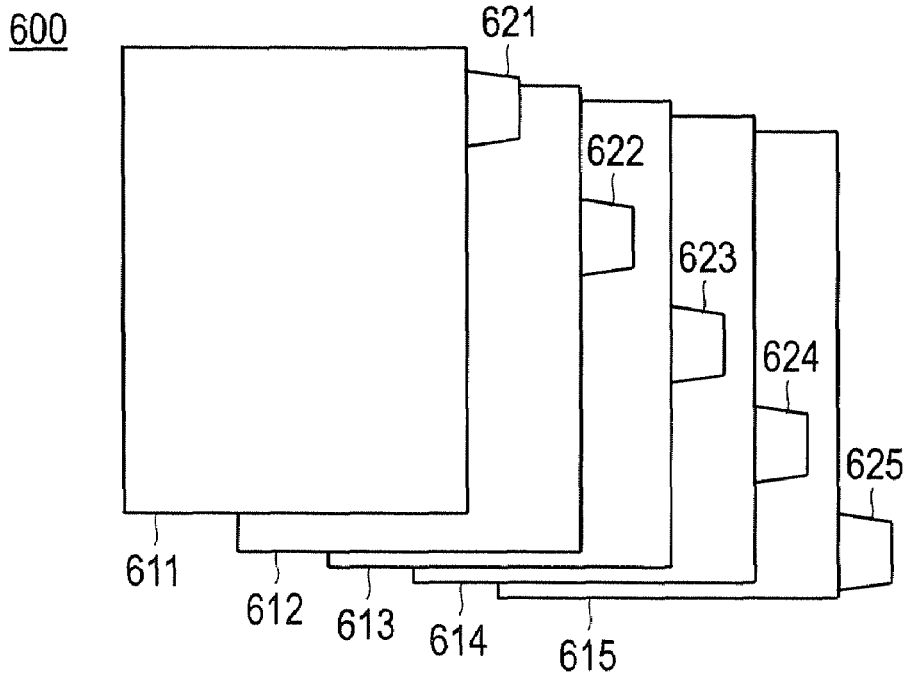

FIG. 6 shows an example of the tab sheet used in this embodiment, wherein (A) illustrates a three tab sheet 500 and (B) illustrates a five tab sheet 600. Tab sheets are also called index sheets. As shown in FIG. 6 (A), the tab sheet 500 is a set consisting of three sheets 511-513 and is called a "three-tab." Each of the tab sheets 511-513 has a flat rectangular main body and a tab 521-523 respectively protruding at a specified position on a side of said main body. As shown in FIG. 6 (B), the tab sheet 600 is a set consisting of five sheets 611-615 and is called a "five-tab." Each of the tab sheets 611-615 has a flat rectangular main body and a tab 621-625 respectively protruding at a specified position on a side of said main body.

The order of the tab sheets shown in FIG. 6 is called the normal order and is arranged in such a way that the tab of an upper layer sheet is found above the tab of a lower layer sheet in FIG. 6 when all of their tabs are on the right side. In case of the three-tab tab sheet 500, the tabs 521-523 are provided on one side of the main body lowering their positions sequentially in three steps from the top to the bottom. The positions of the tabs 521, 522, and 523 are identified as ⅓ (one-third), ⅔ (two-thirds), and ⅗ (three-thirds) respectively. In case of the five-tab tab sheet 600, the tabs 621-625 are provided on one side of the main body lowering their positions sequentially in five steps from the top to the bottom. The positions of the tabs 621, 622, 623, 624, and 625 are identified as ⅕ (one-fifth), ⅖ (two-fifths), ⅗ (three-fifths), ⅘ (four-fifths), and ⅚ (five-fifths) respectively. The tab sheets 500 and 600 are normally provided in multiple sets in the sheet supply tray.

The operation of the network system in this embodiment will be described in the following.

Figure 7:
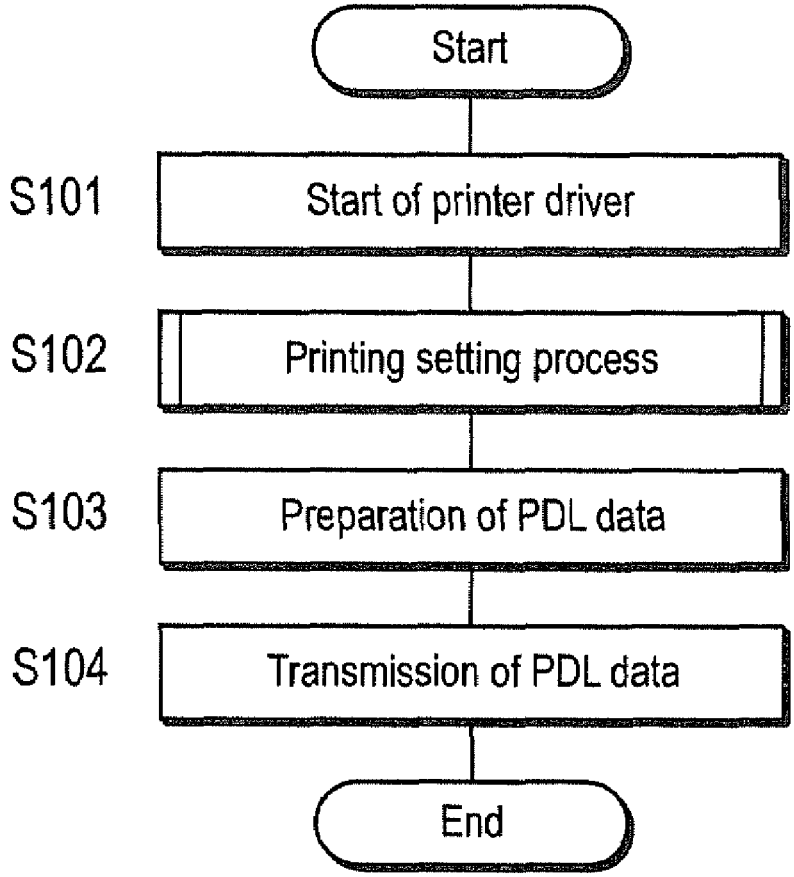
FIG. 7 is a flow chart showing the process procedure on the PC.
Figure 8:
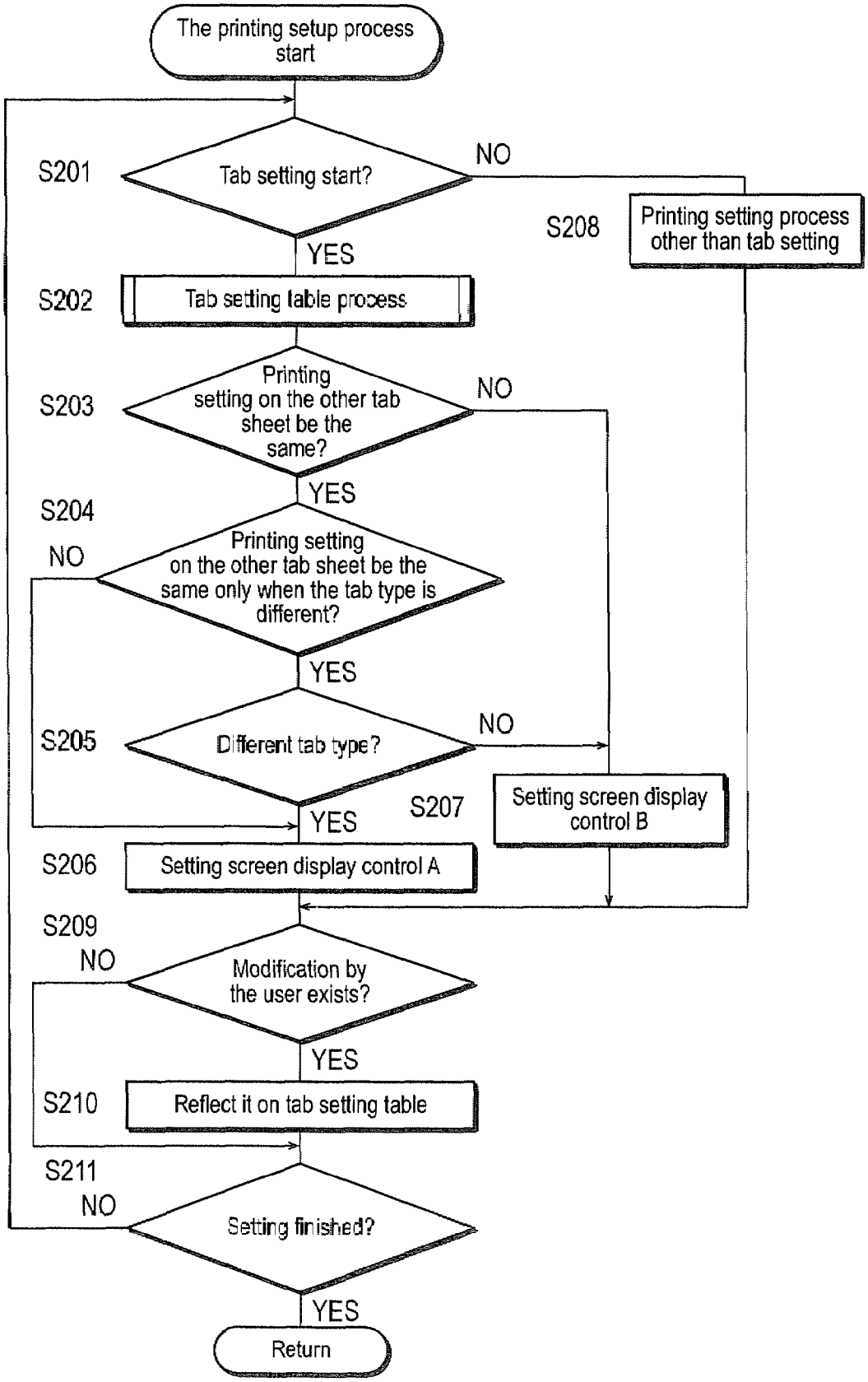
FIG. 8 is a flowchart showing the sequence of the printing setting process.
Figure 9:
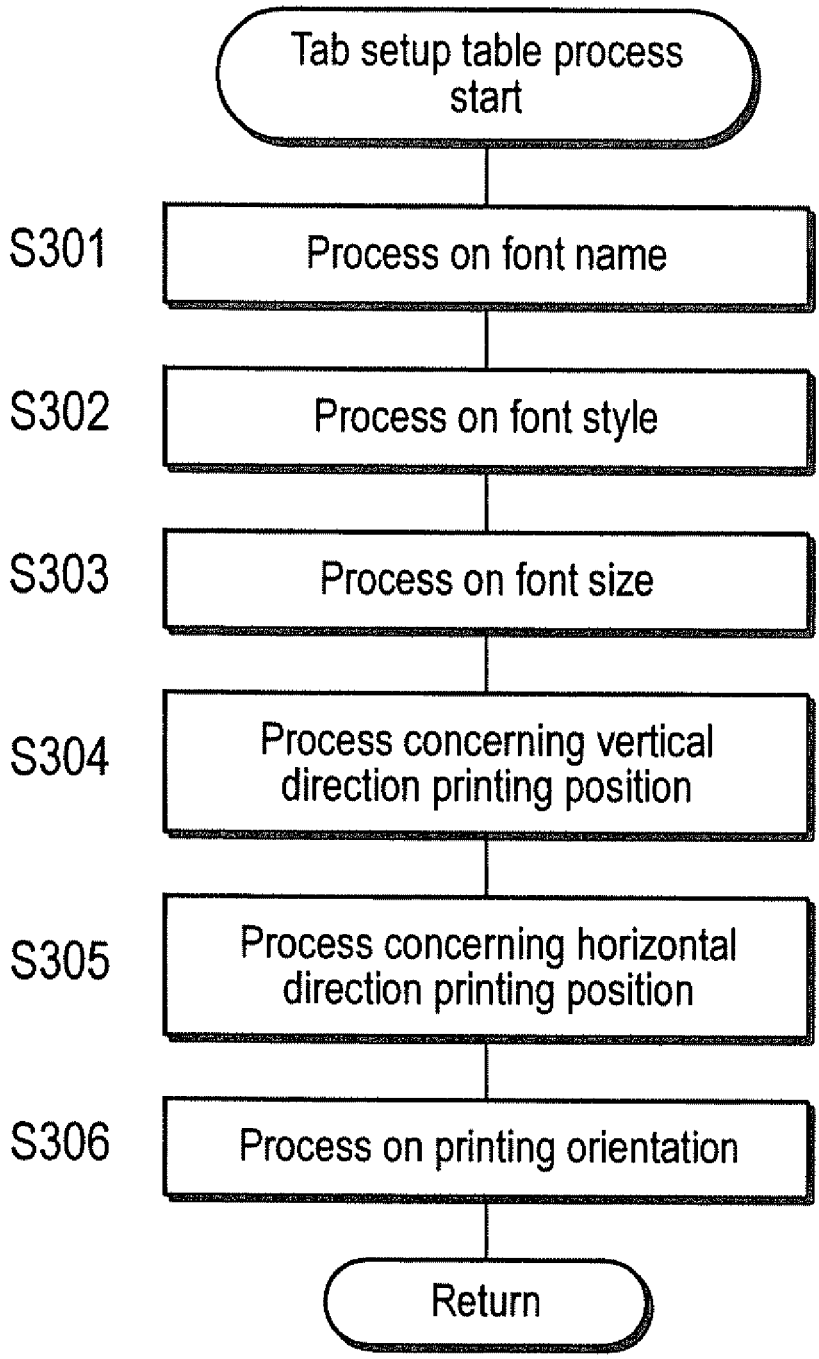
FIG. 9 is a flowchart showing the sequence of the tab setting table process.

FIG. 7-FIG. 9 are flowcharts showing the process procedure on the PC 1. The algorithm shown in the flowcharts of FIG. 7-FIG. 9 is stored as a program in a memory unit such as a hard disk 14 of the PC 1 and executed by the CPU 11.

As a preamble, a document file to be printed is prepared by the PC 1. The document file is prepared by an application installed on the PC 1.

When the printing process for a document file is executed, the printer driver is activated via printing setting dialogs of the application based on the user's operation as shown in FIG. 7 (S101).

Next, a printing setting screen (not shown) is displayed on the display 15 by the printer driver, and the printing setting process is performed via the printing setting screen (S102).

As the first step in the printing setting process, a judgment is made as to whether the setting start request concerning the tab sheet has been received or not by the printing setting screen as shown in FIG. 8 (S201). The setting start request concerning the tab sheet is activated by clicking, for example, the tab sheet setting screen selection part (not shown) on the printing setting screen.

If it is judged that the setting start request concerning the tab sheet is received (S201: Yes), the tab sheet setting screen is displayed on the display 15, and the program proceeds to step S202.

Figure 10:
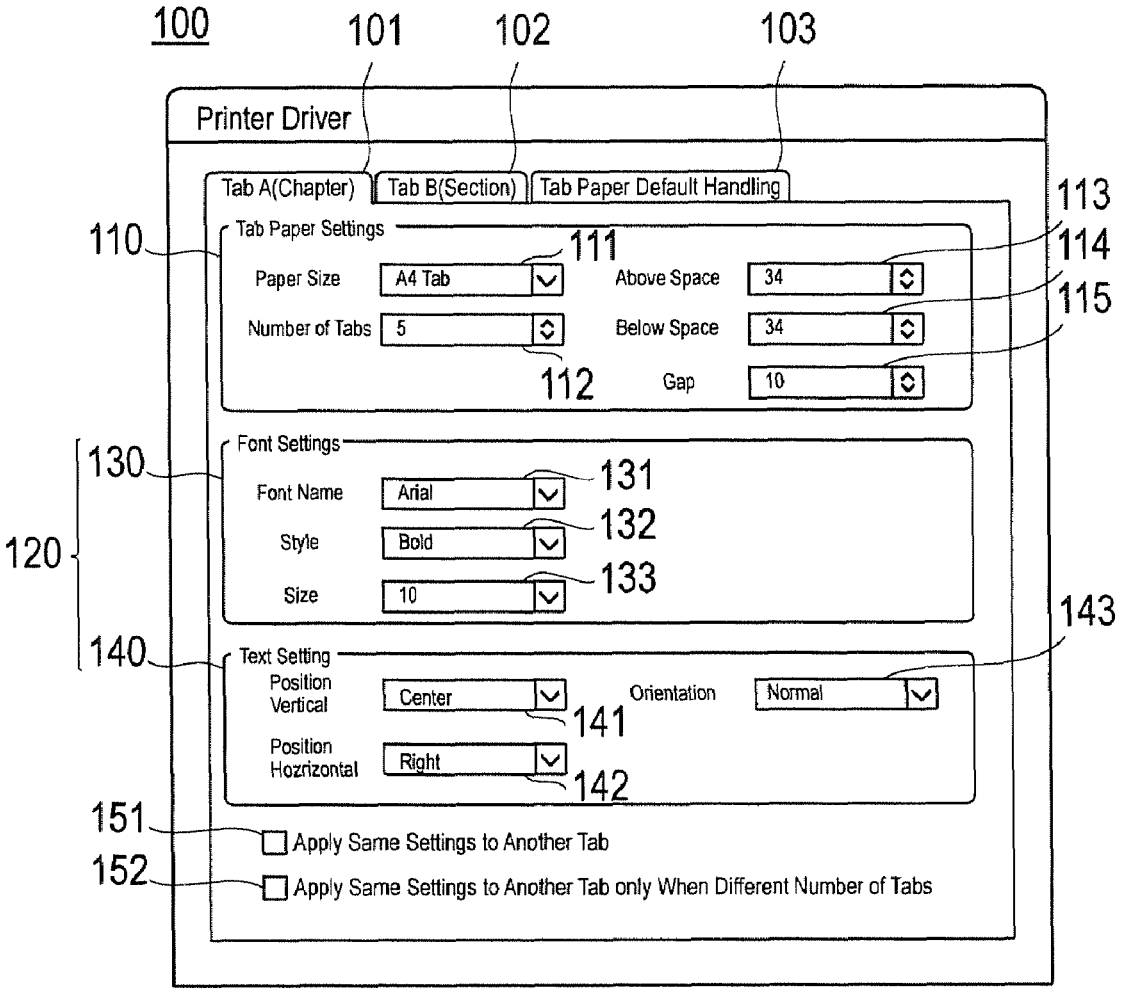
FIG. 10 is a diagram showing an example of the first tab sheet setting screen.

FIG. 10 is a diagram showing an example of a first tab sheet setting screen 100.

The first tab sheet setting screen 100 is the first screen to be opened among various tab sheet setting screens, and it is for setting up items concerning the first tab sheet. The display is switched from the first tab sheet setting screen 100 to a second tab sheet setting screen 200 (refer to FIG. 11) when a setting screen switching part 102 is clicked, and then switched again to a tab printing default value modification setting screen 300 (refer to FIG. 12) for specifying the process of modifying the default values concerning the items concerning the tab sheet printing when a setting screen switching part 103 is clicked. Also, the first tab sheet setting screen 100 has a setting screen switching part 101 for switching from the second tab sheet setting screen 200 or the tab printing default value modification setting screen 300 to the first tab sheet setting screen 100.

Figure 11:
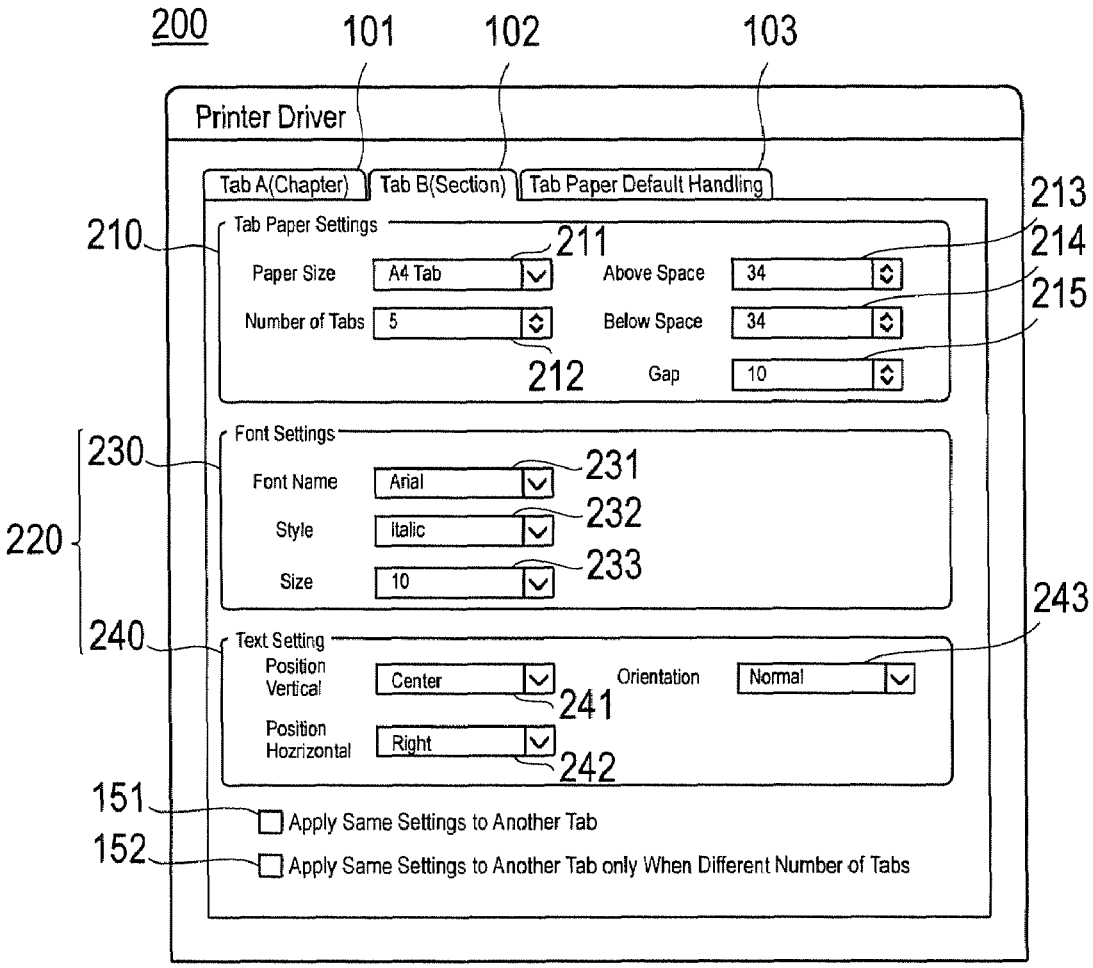
FIG. 11 is a diagram showing an example of the second tab sheet setting screen.
Figure 12:
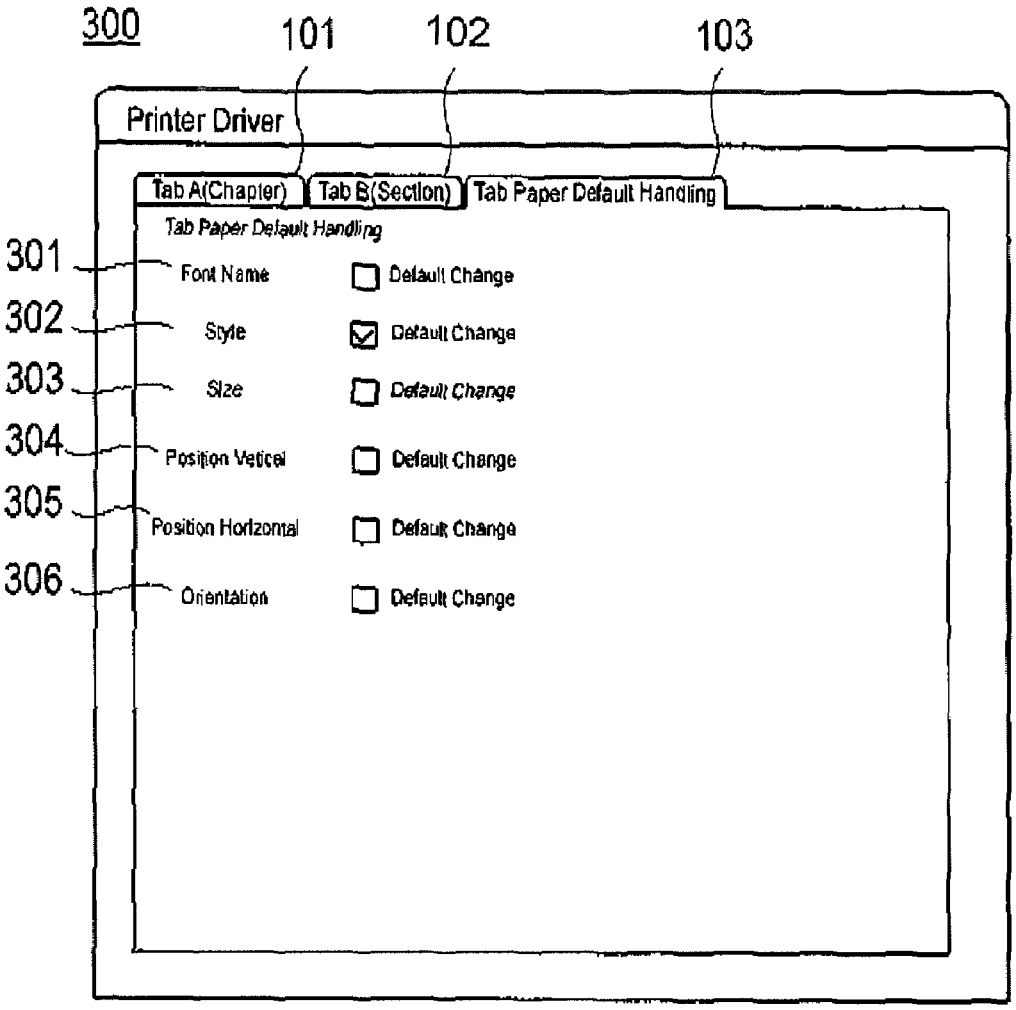
FIG. 12 is a diagram showing an example of the tab printing default value modification setting screen.

In this embodiment, the first tab sheet is indicated as "Tab A" in FIGS. 10-12, and is, for example, the chapter tab sheet used for "chapter" breaks in a document. In this embodiment, the second tab sheet is indicated as "Tab B" in FIGS. 10-12, and is, for example, the section tab sheet used for "section" breaks in a document.

As shown in FIG. 10, the first tab sheet setting screen 100 has a first tab sheet type specifying part 110 for specifying the type of the first tab sheet. The first tab sheet type specifying part 110 includes a tab sheet size specifying part 111 for specifying the tab sheet size, a tab number specifying part 112 for specifying the number of tab sheet (tab number or index number) with different tab positions within one set, a above space setting part 113 for setting up a above space that indicates the distance from the top edge of the tab sheet to the top edge position of the highest level tab, a below space setting part 114 for setting up a below space that indicates the distance from the bottom edge position of the lowest level tab to the bottom edge of the tab sheet, and a gap setting part 115 for specifying the gap between vertically adjacent tabs among tabs serially arranged from the top of one side of the main body.

The first tab sheet setting screen 100 has a first tab printing setting part 120 for setting up items concerning printing on the tab of the first tab sheet and the first tab printing setting part 120 has a font setting part 130 concerning the font of the characters to be printed, and a test setting part 140 concerning the positions and orientations of the characters to be printed. The font setting part 130 includes a font name specifying part 131 for specifying the font name, a font style specifying part 132 for specifying the font style (character style), and a font size specifying part 133 for specifying the font size (character size). Also, the text setting part 140 includes a vertical direction printing position specifying part 141 for specifying the vertical direction printing position within a tab, a horizontal direction printing position specifying part 142 for specifying the horizontal direction printing position within the tab, and a printing orientation specifying part 143 for specifying the printing orientation. It is possible to specify "Up," "Center," or "Down" position in the vertical direction printing position specifying part 141, and "Left," "Center," or "Right" position in the horizontal position printing position specifying part 142. Also, in the printing orientation specifying part 143, it is possible to specify, for example, horizontal writing when viewed from the right-hand side of FIG. 6, horizontal writing when viewed from the left-hand side of FIG. 6, or vertical writing.

Moreover, the first tab sheet setting screen 100 has a first forward link setting part 151 that allows the user to specify the value of an item concerning the printing on the tab on the other tab sheet (the second tab sheet in the present case) be linked with (or in dependence upon) and to be the same as the value of the item set up concerning the printing on the tab of the tab sheet currently being displayed (the first tab sheet in the present case), and a second forward link setting part 152 that allows the user to specify the value of an item concerning the printing on the tab on the other tab sheet (the second tab sheet in the present case) be linked with (or in dependence upon) and to be the same as the value of the item set up concerning the printing on the tab of the tab sheet currently being displayed (the first tab sheet in the present case), only when the first tab sheet and the second tab sheet are of different types. The first forward link setting part 151 and the second forward link setting part 152 are both checkboxes. When either of these checkboxes is check-marked, the forward link function is set up. In the present embodiment, for the sake of process convenience, check-marking the second forward link setting part 152 causes the first link setting part 151 to be check-marked as well automatically.

FIG. 11 is a diagram showing an example of the second tab sheet setting screen 200. The second tab sheet setting screen 200 is a setting screen for setting up an item concerning the second tab sheet.

As shown in FIG. 11, the second tab sheet setting screen 200 has a second tab sheet type specifying part 210 for specifying the type of the second tab sheet. The second tab sheet type specifying part 210 has a tab sheet size specifying part 211, a tab number specifying part 212, an above space setting part 213, a below space setting part 214, and a space setting part 215.

The second tab sheet setting screen 200 has a second tab printing setting 220 for setting up an item concerning the printing on the tab of the second tab sheet, and the second tab printing setting part 220 has a font setting part 230 and a text setting part 240. The font setting part 230 has a font name specifying part 231, a font style specifying part 232, and a font size specifying part 233. The text setting part 240 has a vertical direction printing position specifying part 241 and a horizontal direction printing position specifying part 242, and a printing orientation specifying part 243.

The functions of various setting and specifying parts of the second tab sheet setting screen 200 are identical to those on the first tab sheet setting screen 100. The specifications or designations of the page position at which the tab sheets are to be inserted, the contents of the printing on the tab of the tab sheet, and the like are received at other setting screens (not shown). However, the setting parts of these items can be included in the first tab sheet setting screen 100 and the second tab sheet setting screen 200.

FIG. 12 is a diagram showing an example of the tab printing default value modification setting screen 300.

The tab printing default value modification setting screen 300 has reverse link setting parts 301-306 that allow the user to specify, when the value of an item concerning the printing on the tab of either one of the first tab sheet or the second tab sheet is specified, the value of the item concerning the printing on the tab on another tab sheet to be linked with (or in dependence upon) and to be the same as the value of the item set up concerning the printing on the tab of said one of the tab sheets. The reverse link setting parts 301-306 are all check-boxes. When one of the reverse link setting parts 301-306 are check-marked, the values of the items of the first tab printing setting part 120 and the second tab printing setting part 220 are set up in such a way as to be linked with each other so that they are different from each other.

The reverse link setting part 301 is used for making the font names of the characters to be printed on the tabs of the first and second tab sheets different from each other. The reverse link setting part 302 is used to make the font styles of the characters to be printed on both those tabs are different from each other. The reverse link setting part 303 is used to make the font sizes of the characters to be printed on both those tabs are different from each other. The reverse link setting part 304 is used to make the vertical direction printing positions of the characters to be printed on both those tabs are different from each other. The reverse link setting part 305 is used to make the horizontal direction printing positions of the characters to be printed on both those tabs are different from each other. The reverse link setting part 306 is used to make the printing orientations of the characters to be printed on both those tabs are different from each other.

In the present embodiment, if either the first forward link setting part 151 or the second forward link setting part 152 is check-marked, check-marking the reverse link setting parts 301-306 will be treated ineffective. However, it can also be constituted in such a way that the user's operation on the tab printing default value setting screen 300 will not be accepted if both the first forward link setting part 151 and the second link setting part 152 are check-marked.

On the other hand, if none of the first forward link setting part 151, the second forward link setting part 152, and the reverse link setting parts 301-306 are check-marked, the user can specify freely without causing the linking function of item values on the first tab sheet setting screen 100 and the second tab sheet setting screen 200.

Returning back to the flow chart of FIG. 8, the tab setting table process is conducted in the step S202. The tab setting table process is a process for modifying the tab setting table (refer to FIG. 13) that shows the items concerning the printing on the tabs of both the first tab sheet and the second tab sheet based on the presence or lack of checks on the reverse link setting parts 301-306 of the tab printing default value modification setting screen 300.

FIG. 13 is a diagram showing an example of the tab setting table 400. The tab setting table 400 has a row 401 for indicating font names of characters to be printed on the tabs of the first tab sheet and the second tab sheet, a row 402 for indicating the font styles of characters to be printed on both tabs, a row 403 for indicating the font sizes of the characters to be printed on both tabs, a row 404 for indicating the vertical direction printing position of the characters to be printed on both tabs, a row 405 for indicating the horizontal direction printing positions of the characters to be printed on both tabs, and a row 406 for indicating the printing orientation of the characters printed on both tabs. The tab setting table 400 is stored in the storage unit such as the RAM 13 and predetermined default initial values are stored in each of the rows 401-406 respectively.

When the tab setting table process starts as shown in FIG. 9, the font name process is performed first (S301).

In the font name process, a judgment is made whether or not the font name is a target item of the default value modification. More specifically, a judgment is made whether or not the reverse link setting part 301 of the tab printing default value modification setting screen 300 is check-marked. If the font name mark is the target of the default value modification, the font name set up in the tab setting table 400 is detected for the tab sheet (e.g., the first tab sheet) that corresponds to the currently displayed tab sheet setting screen (e.g., the first tab sheet setting screen 100). Next, a font name different from the font name detected as mentioned above is set as the font name for the tab setting table 400 concerning a tab sheet (e.g., the second tab sheet), which is of a type different from that of the tab sheet (e.g., the first tab sheet) that corresponds to the tab sheet setting screen currently displayed (e.g., the first tab sheet setting screen 100). The data that indicates the combination of the font name detected as above and the font name that is different from it is stored in a predetermined storage unit such as RAM 13. However, the data that indicates the combination can be constituted in such a way as to be able to be specified by the user. On the other hand, if it is judged that the font name is not the target of the default value modification, the program advances to the next step.

Next, the process about the font style (S302), the process about the font size (S303), the process about the vertical direction printing position (S304), the process about the horizontal direction printing (S305), and the process about the printing orientation (S306) are executed in a similar manner as those of step S301 although the types of items are different.

For example, if the reverse link setting part 302 is check-marked as shown in FIG. 12, the font style (Bold) of the characters to be printed on the tab of the first tab sheet and the font style (Italic) of the characters to be printed on the tab of the second tab sheet are linked to be different from each other and stored into the tab set up table 400 as shown in FIG. 13.

Although the present embodiment is constituted in such a way as to modify the values of items concerning printing on the tab of a tab sheet whose type is different from that of the tab sheet corresponding to the tab sheet setting screen currently being displayed, the invention is not limited to such a constitution. For example, it can be constituted in such a way as to modify the values of items concerning printing on the tab of a tab sheet corresponding to the tab sheet setting screen currently being displayed, and it can be constituted furthermore in such a way that the values of items concerning printing on the tabs of both tab sheets are markedly different. Moreover, the order of execution of steps S301-S306 can be modified.

Returning back to the flowchart of FIG. 8, a judgment is made in step S203 as to whether or not it is specified to set up the values of items concerning the printing on the tab of the other tab sheet in such a way as to link with the values of items that are set up concerning the printing on the tab of a tab sheet corresponding the tab sheet setting screen that is currently being displayed. More specifically, a judgment is made as to whether the first forward link setting part 151 is check-marked or not.

If it is judged that the first forward link setting part 151 is check-marked (S203: Yes), a judgment is made whether or not it is specified to set up the values of the items concerning the printing on the tab of the other tab sheet to be linked with and to be the same as the values of the items set up concerning the printing on the tab of the tab sheet corresponding to the tab sheet setting screen currently being displayed, when the first tab sheet and the second tab sheet are of different types. More specifically, a judgment is made as to whether the second forward link setting part 152 is check-marked or not.

If it is judged that the second forward link setting part 152 is not check-marked in step S204 (S204: No), the program advances to step S206.

On the other hand, if it is judged that the second forward setting part 152 is check-marked in step S204 (S204: No), a judgment is made as to whether or not the first tab sheet and the second tab sheet are of different types (S205). If the first tab sheet and the second tab sheet are of different types, either the tab sheet sizes are different, or the tab numbers are different.

If it is judged that the first tab sheet and the second tab sheet are of different types (S205: Yes), the program advances to step S206. If the first tab sheet and the second sheet are of different types, they are easily distinguishable by the user at a glance, so that it is expected that the user may allow the values of the items concerning tab printing be equal.

In step S206, the setting screen display control A is performed. In this setting screen display control A, the tab setting table 400 is modified to allow the values of the items concerning the tab printing of the other tab sheet be linked with and to be the same as the values of the items concerning the tab printing of the tab sheet corresponding to the tab sheet setting screen currently being displayed. Thus, the tab sheet setting screen is displayed based on the modification contents of the tab setting table 400 when the display is switched to the tab sheet setting screen for the other tab sheet.

On the other hand, if it is judged in step S203 that the first forward link setting part 151 is not check-marked (S203: No), or if it is judged in step S205 that the first tab sheet and the second tab sheet are of the same type (S205: No), the program advances to step S207.

In step S207, the setting screen display control B is performed. In the setting screen display control B, the tab sheet setting screen currently being displayed is updated based on the contents of that the tab setting table 400.

In step S209, a judgment is made as to whether or not the value of any item concerning the printing on the tab of the tab sheet has bee modified. If it is judged that a modification has been made by the user (S209: Yes), the contents of such a modification are reflected on the tab setting table 400 (S210). If it is judged that no modification has been made by the user (S209: No), the program advances to step S211.

On the other hand, if it is judged that a setting start request concerning the tab sheet has been received by the printing setting screen as shown in step S201 (S201: No), the printing setting process is executed by displaying the printing setting screen other than tab sheet setting is displayed on the display 15 (S208). For example, paper size, finishing process such as stapling, and others are specified.

In step S211, a judgment is made as to whether the printing setting work is finished or not. For example, when the display is switched to another printing setting screen, different from the tab sheet setting screen, and the instruction part for printing start is clicked, it is judged that the printing setting work is finished. If the printing setting work is not finished (S211: No), the program returns to step S201.

If the printing setting work is completed (S211: Yes), the program returns to the flowchart of FIG. 7, and PDL data is generated as the document file prepared by using the application is converted in step S103.

In the PDL data, the setting information concerning the tab sheet is described as the command data. Setting information concerning printing setting other than the setting concerning the tab sheet is also described as command data in the PDL data.

Next, in step S104, the PDL data thus prepared is transmitted to the printer controller 2 of the printing system 4 via the network 5.

Figure 14:
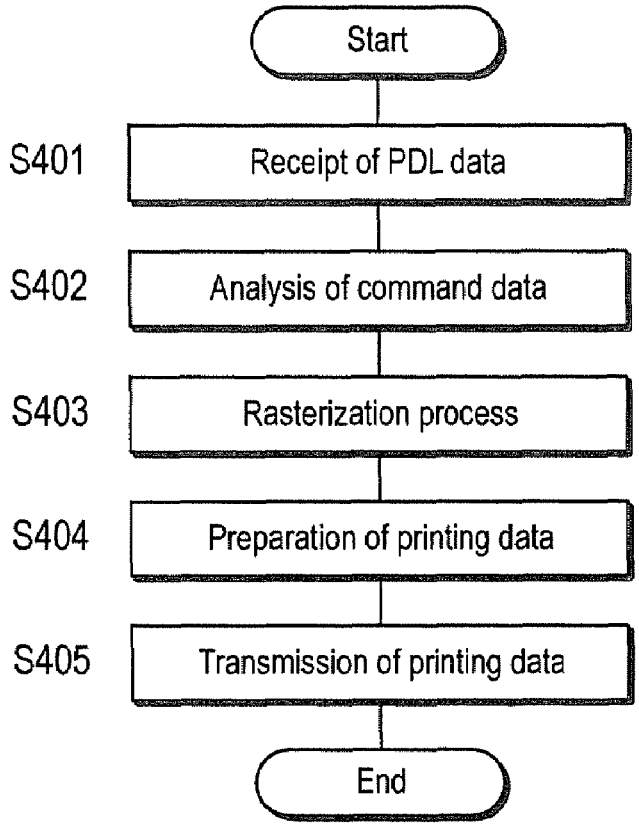
FIG. 14 is a flowchart showing the process sequence on the printer controller.

Next, the job process in the printer controller 2 will be described below referring to FIG. 14. The algorithm shown in the flowchart of FIG. 10 is stored as a program in a memory unit such as a hard disk 24 of the printer controller 2 and executed by the CPU 21.

First, the printer controller 2 receives the PDL data from the PC1 (step S401), and analyzes the command data described in the PDL data (S402). The setting information concerning the tab sheet is identified as the command data is analyzed.

Next, the received PDL data is rasterized in order to obtain bitmap data, which is bitmap type image data (S403).

Printing data is then prepared by adding header information containing setting information concerning the tab sheet to the bitmap data thus obtained in step S403 (S404), and the particular printing data is transmitted to the printer 3 as a printing job (S405).

Figure 15:
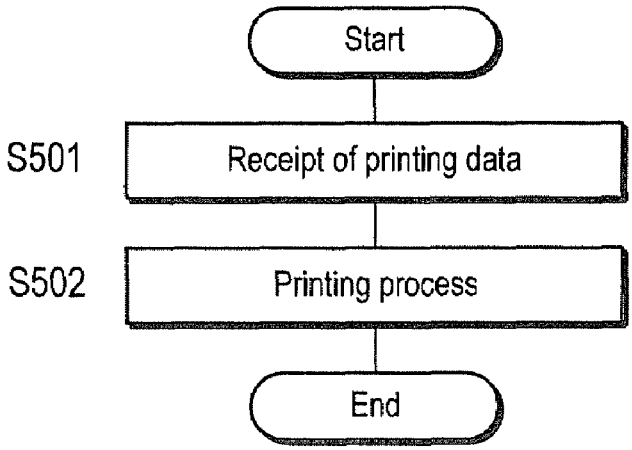
FIG. 15 is a flowchart showing the process sequence on the printer.

Next, the job process in the printer 3 will be described below referring to FIG. 15. The algorithm shown in the flowcharts of FIG. 15 is stored as a program in a memory unit such as a ROM 32 of the printer 3 and executed by the CPU 31.

The printer 3 receives the printing data from the printer controller 2 as the printing job (step S501). Next, the printer 3 executes the printing process (S502). When the printing process starts, the header information of the printing job is analyzed first. As normal printing is processed page by page, a specified tab sheet is supplied from a specified supply tray at a page where a tab sheet insertion is specified. Printing is executed on the tab of the tab sheet supplied from the supply tray based on the setting information concerning the tab sheet.

In this embodiment, as described in the above, the user is provided with the first tab printing setting part 120 for setting up items concerning the printing on the first tab sheet and the second tab printing setting part 220 for setting up items concerning the printing on the second tab sheet, so that, when the value of one of the items is set up in either one of the first tab printing setting part 120 and the second tab printing setting part 220, the value of the corresponding item of the other one of the first tab printing setting part 120 and the second tab printing setting part 220 is set up liked to the value of the item of said one of the parts. For example, there is a setting item concerning the tab sheet called "font name" so that it can be controlled in such a way that, when a value "Arial" is set up as the particular item for the first tab sheet, the value of the "font name" of the second tab sheet is determined linked with it.

Therefore, the user can alleviate the burden of separately setting up the items related to tab printings on the chapter tab sheet and the section tab sheet, as well as prevent causing accidental setting errors contrary to the user's intention.

In other words, this makes it possible for the user to set up multiple types of tab sheets while increasing productivity and minimizing the chance of causing errors.

By constituting in such a way as to set up the value of an item in one of the first printing setting part 120 and the second printing setting part 220 to be linked with the value of the corresponding item in the other one of the parts, the user can easily distinguish the tab sheet used for the "chapter" break from the tab sheet used for the "section" break at a glance, so that the user can easily and speedily find the desired page based on the tab sheets.

The invention is not limited to the embodiment described above, but also can be changed in various ways within the scope of the claims.

For example, although a case of two types of tab sheets are inserted is described in the above embodiments, the present invention is applicable to a case inserting more three or more types of tab sheets. For example, although we used "chapter" and "section" as examples of breakpoints in a document in the above embodiments, the present invention is not limited to them. The breakpoints of a document can be limited to "part" and "chapter" breaks or can include "part," "chapter," and "section," or more breaks.

Moreover, although it is described in the above embodiment a case of the process of setting up tab sheets being executed by the printer driver, it can be executed by an application instead of the printer driver.

Further, although it is described in the above embodiment a case of the setting concerning tab sheets is conducted using the tab sheet setting screen, which is displayed on the display 15 of the PC 1, it can be executed using the tab sheet setting screen, which is displayed on the operating panel unit 34 of the printer 3.

Furthermore, although it is describe in the above embodiment a constitution wherein the printing system 4 is divided into the printer controller 2 and the printer 3, both of which are locally connected, the printer controller 2 can be built into the printer 3.

Also, although the embodiments described above uses a printer as the image forming apparatus, the invention is not limited to it. The present invention is applicable to an image forming apparatus such as MFP (Multi-Function Peripheral) and a copying machine as well.

The means and method of conducting various processes in the network system according to the present invention can be realized by means of a dedicated hardware circuit, or a programmed computer. Said program can be provided either by a computer readable recording medium such as a flexible disk and a CD-ROM, or by being supplied on-line via a network such as the Internet. In this case, the program recorded on the computer readable storage medium is normally transferred to and stored in a memory unit such as a hard disk. Said program can also be provided as independent application software or can be built into the software of the image processing device as a part of its function.

What is claimed is:

1. A computer readable recording medium stored with a control program for controlling an image forming apparatus, said control program causing a computer to execute a process comprising:

1) providing a user with a first setting part for setting up an item concerning printing on a first tab sheet and a second setting part for setting up an item concerning printing on a second tab sheet; and 2) setting up, when a value of an item in one of said first and second setting parts is set up, a value of the corresponding item in the other one of said first and second setting parts in dependence upon the value of the item in said one of the first and second setting parts.

2. The computer readable recording medium as claimed in claim 1, wherein in step 2), the value of the item in said other one of said first and second setting parts is set up in dependence upon and to be different from the value of the corresponding item of said one of the first and second setting parts.

3. The computer readable recording medium as claimed in claim 2, wherein the item to be linked in such a way that it is different from each other in said first setting part and said second setting part is the item specified by the user.

4. The computer readable recording medium as claimed in claim 1, wherein in step 2), the value of the item in said other one of said first and second setting parts is set up in dependence upon and to be the same as the value of the corresponding item of said one of the first and second setting parts.

5. The computer readable recording medium as claimed in claim 1, wherein in step 2), the value of said item in said other one of said first and second setting parts is set up in dependence upon and to be the same as the value of said item of said one of the first and second setting part if said first tab sheet is different in type from said second tab sheet.

6. The computer readable recording medium as claimed in claim 1, wherein step 2) is executed when the dependency between the values of the item in said first and second setting parts is specified by the user.

7. The computer readable recording medium as claimed in claim 1, wherein the items include at least one of the font name, character style, character size, vertical printing position, horizontal printing position, and printing orientation.

8. A printing setting apparatus, comprising:

a first setting part for setting up items concerning printing on a first tab sheet;

a second setting part for setting up items concerning printing on a second tab sheet; and a control unit that, when a value of an item in one of said first and second setting parts is set up, sets up a value of the corresponding item in the other one of said first and second setting parts in dependence upon the value of the item in the one of the first and second setting parts.

9. The printing setting apparatus as claimed in claim 8, wherein the control unit sets up the value of the item in said other one of said first and second setting parts in dependence upon and to be different from the value of the corresponding item of said one of the first and second setting parts.

10. The printing setting apparatus as claimed in claim 9, wherein the item to be linked in such a way that it is different from each other in said first setting part and said second setting part is the item specified by a user.

11. The printing setting apparatus as claimed in claim 8, wherein the control unit sets up the value of the item in said other one of said first and second setting parts in dependence upon and to be the same as the value of the corresponding item of said one of the first and second setting parts.

12. The printing setting apparatus as claimed in claim 8, wherein the control unit sets up the value of said item in said other one of said first and second setting parts in dependence upon and to be the same the value of said item of said one of the first and second setting part if said first tab sheet is different in type from said second tab sheet.

13. The printing setting apparatus as claimed in claim 8, wherein the control unit sets up the value of said item in said other one of said first and second setting parts when the dependency between the values of the item in said first and second setting parts is specified by a user.

14. The printing setting apparatus as claimed in claim 8, wherein the items include at least one of the font name, character style, character size, vertical printing position, horizontal printing position, and printing orientation.

15. A printing method, comprising:

1) providing a user with a first setting part for setting up items concerning printing on a first tab sheet and a second setting part for setting up items concerning printing on a second tab sheet; and 2) when a value of an item in one of said first and second setting parts is set up, setting up a value of the corresponding item in the other of said first and second setting parts in dependence upon the value of the item in said one of the first and second setting parts.

16. The printing method as claimed in claim 15, wherein in step 2), the value of the item in said other one of said first and second setting parts is set up in dependence upon and to be different from the value of the corresponding item of said one of the first and second setting parts.

17. The printing method as claimed in claim 16, wherein the item to be linked in such a way that it is different from each other in said first setting part and said second setting part is the item specified by the user.

18. The printing method as claimed in claim 15, wherein in step 2), the value of the item in said other one of said first and second setting parts is set up in dependence upon and to be the same as the value of the corresponding item of said one of the first and second setting parts.

19. The printing method as claimed in claim 15, wherein in step 2), the value of said item in said other one of said first and second setting parts is set up in dependence upon and to be the same as the value of said item of said one of the first and second setting part if said first tab sheet is different in type from said second tab sheet.

20. The printing method as claimed in claim 15, wherein step 2) is executed when the dependency between the values of the item in said first and second setting parts is specified by the user.

21. The printing method as claimed in claim 15, wherein the items include at least one of the font name, character style, character size, vertical printing position, horizontal printing position, and printing orientation.

22. A computer readable recording medium stored with a control program for controlling an image forming apparatus, said control program causing a computer to execute a process comprising:

1) providing a user with a first setting part for setting up an item concerning printing on a group of first tab sheets for dividing printed sheets by a first divisional unit and a second setting part for setting up an item concerning printing on a group of second tab sheets for dividing said printed sheets by a second divisional unit that is different from said first divisional unit; and 2) setting up, when a value of an item in one of said first and second setting parts is set up, a value of the corresponding item in the other one of said first and second setting parts in dependence upon the value of the item in said one of the first and second setting parts.

23. The computer readable recording medium as claimed in claim 22, wherein said second divisional unit is small than said first divisional unit.

24. The computer readable recording medium as claimed in claim 22, wherein in step 2), the value of the item in said other one of said first and second setting parts is set up in dependence upon and to be different from the value of the corresponding item of said one of the first and second setting parts.

25. The computer readable recording medium as claimed in claim 24, wherein the item to be linked in such a way that it is different from each other in said first setting part and said second setting part is the item specified by the user.

26. The computer readable recording medium as claimed in claim 22, wherein in step 2), the value of the item in said other one of said first and second setting parts is set up in dependence upon and to be the same as the value of the corresponding item of said one of the first and second setting parts.

27. The computer readable recording medium as claimed in claim 22, wherein in step 2), the value of said item in said other one of said first and second setting parts is set up in dependence upon and to be the same as the value of said item of said one of the first and second setting part if said group of first tab sheets is different in type from said group of second tab sheets.

28. The computer readable recording medium as claimed in claim 22, wherein step 2) is executed when the dependency between the values of the item in said first and second setting parts is specified by the user.

29. The computer readable recording medium as claimed in claim 22, wherein the items include at least one of the font name, character style, character size, vertical printing position, horizontal printing position, and printing orientation.

30. A printing setting apparatus, comprising:

a first setting part for setting up items concerning printing on a group of first tab sheets for dividing printed sheets by a first divisional unit;

a second setting part for setting up items concerning printing on a group of second tab sheets for dividing said printed sheets by a second divisional unit that is different from said first divisional unit; and a control unit that, when a value of an item in one of said first and second setting parts is set up, sets up a value of the corresponding item in the other one of said first and second setting parts in dependence upon the value of the item in the one of the first and second setting parts.

31. The printing setting apparatus as claimed in claim 30, wherein said second divisional unit is small than said first divisional unit.

32. The printing setting apparatus as claimed in claim 30, wherein the control unit sets up the value of the item in said other one of said first and second setting parts in dependence upon and to be different from the value of the corresponding item of said one of the first and second setting parts.

33. The printing setting apparatus as claimed in claim 32, wherein the item to be linked in such a way that it is different from each other in said first setting part and said second setting part is the item specified by a user.

34. The printing setting apparatus as claimed in claim 30, wherein the control unit sets up the value of the item in said other one of said first and second setting parts in dependence upon and to be the same as the value of the corresponding item of said one of the first and second setting parts.

35. The printing setting apparatus as claimed in claim 30, wherein the control unit sets up the value of said item in said other one of said first and second setting parts in dependence upon and to be the same as the value of said item of said one of the first and second setting part if said group of first tab sheets is different in type from said group of second tab sheets.

36. The printing setting apparatus as claimed in claim 30, wherein the control unit sets up the value of said item in said other one of said first and second setting parts when the dependency between the values of the item in said first and second setting parts is specified by a user.

37. The printing setting apparatus as claimed in claim 30, wherein the items include at least one of the font name, character style, character size, vertical printing position, horizontal printing position, and printing orientation.

38. A printing method, comprising:

1) providing a user with a first setting part for setting up items concerning printing on a group of first tab sheets for dividing printed sheets by a first divisional unit and a second setting part for setting up items concerning printing on a group of second tab sheets for dividing said printed sheets by a second divisional unit that is different from said first divisional unit; and 2) when a value of an item in one of said first and second setting parts is set up, setting up a value of the corresponding item in the other of said first and second setting parts in dependence upon the value of the item in said one of the first and second setting parts.

39. The printing method as claimed in claim 38, wherein said second divisional unit is small than said first divisional unit.

40. The printing method as claimed in claim 38, wherein in step 2), the value of the item in said other one of said first and second setting parts is set up in dependence upon and to be different from the value of the corresponding item of said one of the first and second setting parts.

41. The printing method as claimed in claim 40, wherein the item to be linked in such a way that it is different from each other in said first setting part and said second setting part is the item specified by the user.

42. The printing method as claimed in claim 38, wherein in step 2), the value of the item in said other one of said first and second setting parts is set up in dependence upon and to be the same as the value of the corresponding item of said one of the first and second setting parts.

43. The printing method as claimed in claim 38, wherein in step 2), the value of said item in said other one of said first and second setting parts is set up in dependence upon and to be the same as the value of said item of said one of the first and second setting part if said group of first tab sheets is different in type from said group of second tab sheets.

44. The printing method as claimed in claim 38, wherein step 2) is executed when the dependency between the values of the item in said first and second setting parts is specified by the user.

45. The printing method as claimed in claim 38, wherein the items include at least one of the font name, character style, character size, vertical printing position, horizontal printing position, and printing orientation.

* * * * *